US005849448A

United States Patent [19]

Yoshino et al.

[11] Patent Number: 5,849,448

[45] Date of Patent: Dec. 15, 1998

[54] CARRIER FOR DEVELOPER OF ELECTROSTATIC LATENT IMAGE, METHOD FOR MAKING SAID CARRIER

[75] Inventors: Susumu Yoshino; Satoshi Inoue; Kaori Ohishi; Shinpei Takagi; Sakon Takahashi; Noriyuki Mizutani, all of Minami-ashigara, Japan

[73] Assignee: Fuji Xerox Co., Ltd., Tokyo, Japan

[21] Appl. No.: 818,454

[22] Filed: Mar. 17, 1997

[30] Foreign Application Priority Data

Apr. 1, 1996 [JP] Japan ..... 8-078503

[51] Int. Cl.[6] ..... G03G 9/113

[52] U.S. Cl. ..... 430/108; 430/137; 399/270

[58] Field of Search ..... 430/106, 108, 430/137; 399/270

[56] References Cited

U.S. PATENT DOCUMENTS

| | | | |
|---|---|---|---|
| 4,849,317 | 7/1989 | Sawatari et al. | 430/108 |
| 5,346,791 | 9/1994 | Ozawa et al. | 430/106.6 |
| 5,516,619 | 5/1996 | Cunningham et al. | 430/108 |
| 5,700,615 | 12/1997 | Silence et al. | 430/108 |

FOREIGN PATENT DOCUMENTS

| | | |
|---|---|---|
| 0 254 436 A | 1/1988 | European Pat. Off. . |
| 39 26 029 A | 2/1990 | Germany . |
| A-60-186844 | 9/1985 | Japan . |
| A-61-80161 | 4/1986 | Japan . |
| A-61-80162 | 4/1986 | Japan . |
| A-61-80163 | 4/1986 | Japan . |
| A-64-13560 | 1/1989 | Japan . |
| A-64-7046 | 1/1989 | Japan . |
| A-1-105264 | 4/1989 | Japan . |
| A-1-118150 | 5/1989 | Japan . |
| A-2-79862 | 3/1990 | Japan . |
| A-5-61261 | 3/1993 | Japan . |
| A-5-72813 | 3/1993 | Japan . |

*Primary Examiner*—John Goodrow
*Attorney, Agent, or Firm*—Oliff & Berridge, PLC

[57] ABSTRACT

The present invention provides a carrier for developer of an electrostatic latent image and related technologies. The carrier is excellent in the ability to impart charge suitably and stably to toner and has a structure durable enough to maintain the ability for a long period of time such that the structure can prevent the toner from being adhered onto the carrier surface for a long period of time.

The carrier comprises a core covered with a resin coating layer containing resin particles and an electroconductive fine powder in the form of a dispersion in a matrix resin.

The carrier can be produced by a method comprising the steps of preparing a coating solution by placing materials in a solvent which can dissolve the matrix resin, but cannot dissolve the resin particles, dispersing the particles of the resin, applying the solution to a core and removing the solvent. A high-quality image can be formed by use of the developer comprising the carrier and the toner.

20 Claims, 2 Drawing Sheets

CARRIER FOR DEVELOPER OF ELECTROSTATIC LATENT IMAGE, METHOD FOR MAKING SAID CARRIER

BACKGROUND OF THE INVENTION

1. Field of the Invention

The present invention relates to a carrier for developer of an electrostatic latent image in electrostatic photography and electrostatic recording, a method for making the carrier, a developer of an electrostatic latent image, a method for forming an image and an apparatus for forming an image.

2. Description of the Related Art

In electrostatic photography, a process, which has been generally employed for developing an electrostatic latent image, comprises the steps of forming an electrostatic latent image on a photoreceptor or an electrostatic recording member by use of a variety of means and adhering electroconductive fine particles called toner to the electrostatic latent image to develop it. In this process, an appropriate amount of positive or negative charge is given to the toner by frictional charging resulting from blending carrying particles called a carrier with the toner particles.

Generally, a carrier is roughly divided into a coated carrier, which has a coating layer on the surface thereof, and an uncoated carrier which has no coating layer on the surface thereof. Since a coated carrier is superior to an uncoated carrier in light of the life of developer, various types of coated carriers have been developed and put to practical uses. Examples of requirements for a coated carrier are to impart a proper charge characteristic (amount of charge and distribution of charge) to toner in a stable manner and to maintain the proper and stable charge characteristic for a long period of time. In order to meet the requirements, what is important is that the carrier has proper electrical properties and that the resistance of the carrier to the fluctuation in environments such as temperature or humidity, impact resistance and friction resistance are so high that the function to provide the charge characteristic does not vary for a long period of time. And, various coated carriers have been proposed.

As an attempt to overcome some of the above-mentioned problems, according to Japanese Patent Application Laid-Open (JP-A) Nos. 61-80161, 61-80162 and 61-80163, a carrier having a relatively long life is obtainable by coating the carrier core surface with a copolymer of a nitrogen-containing fluorinated alkyl (meth)acrylate and a vinyl-based monomer or with a copolymer of a fluorinated alkyl (meth)acrylate and a nitrogen-containing vinyl-based monomer.

Further, according to Japanese Patent Application Laid-Open (JP-A) No. 1-118150, a carrier having a relatively hard coating layer is obtainable by a process comprising coating the carrier core surface with a polyamide resin and hardening the polyamide resin. Furthermore, according to Japanese Patent Application Laid-Open (JP-A) No. 2-79862, a carrier having a relatively hard coating layer is obtainable by a process comprising coating the carrier core surface with a melamine resin and curing the melamine resin.

However, since all of the above-cited methods are based on the selection of a suitable material for the carrier, other method is sought which can overcome the problems from a different point of view.

Accordingly, what is expected is to improve a carrier by changing its structure so that the charge imparting characteristic is improved and maintained for a long period of time.

Meanwhile, the above-described conventional coated carriers are not satisfactory, because the prevention adhesion of toner component onto the carrier surface is not perfect. That is, despite the requirement of a function that a carrier should carry toner and a function that the carrier should impart a charge to the toner for a long period of time in a stable manner, the latter function does not work effectively because the toner is gradually adhered onto the carrier surface.

In order to prevent adhesion of toner onto the carrier surface, it is effective to use a silicone resin as described in Japanese Patent Application Laid-Open (JP-A) No.60-186844 or to use a fluorine-containing resin as described in Japanese Patent Application Laid-Open (JP-A) No.64-13560. However, use of these resins concurrently with the aforementioned polymers or resins for coating a carrier core surface is still insufficient for the long-term prevention of adhesion of toner onto a carrier, because the upper portion of the coating layer is rich in the silicone resin or fluorine-containing resin, which will be lost in a long period of use of the carrier due to the wear that starts from the surface of the carrier. This aspect also calls for the improvement of a carrier from a structural side.

With regard to the above-mentioned problems, Japanese Patent Application Laid-Open (JP-A) No.1-105264 discloses a technique which is still based on the selection of a resin to be used for a carrier but which does not limit the resin to a specified one. The disclosed technique is based on a carrier having a coating layer containing a plurality of resins, which are mutually insoluble, and electroconductive particles. This technique, however, cannot satisfactorily solve the above-mentioned problems.

SUMMARY OF THE INVENTION

Accordingly, a first object of the present invention is to provide a carrier for developer of an electrostatic latent image, wherein the carrier is excellent in the ability to provide a suitable and stable charge characteristic to toner and the carrier has a construction durable enough to maintain the ability for a long period of time such that the construction can prevent adhesion of toner onto the carrier surface for a long period of time.

A second object of the present invention is to provide a suitable method for making the carrier.

A third object of the present invention is to provide a developer of an electrostatic latent image by use of the carrier.

A fourth object of the present invention is to provide an image forming method capable of producing a high-quality image by use of the carrier.

A fifth object of the present invention is to provide an image forming apparatus utilizing the carrier as an element.

In order to overcome the above-mentioned problems associated with conventional techniques, the present inventors have conducted studies of a carrier for developer of an electrostatic latent image from a viewpoint different from that of prior art, and, as a result, they have succeeded in solving the problems by the adoption of the following construction of a carrier.

Accordingly, the first object of the present invention can be achieved by a carrier for developer of an electrostatic latent image, in which the carrier comprises a core covered with a resin coating layer containing fine resin particles and an electroconductive fine powder in the form of a dispersion in a matrix resin.

Since the carrier comprises structural components different from each other in construction, i.e., a matrix resin and resin particles, and since the carrier allows to select the two materials in a suitable manner, it is possible to enhance one or two properties out of a number of properties, i.e., capability to provide a stable charge characteristic, mechanical strength and prevention of adhesion of toner onto the carrier by one of the materials and to enhance the rest of the properties by the other material. For example, it is possible to enhance the capability to provide a stable charge characteristic and mechanical strength by the fine resin particles and to sufficiently prevent adhesion of toner onto a carrier by the matrix resin.

In addition, the fact that the fine resin particles can be dispersed uniformly in the matrix resin favors the stable exhibition of the capability to provide charge characteristic to toner and of preventing toner from being adhered onto the carrier. Further, since the uniform dispersion enables the carrier to maintain a surface constitution equivalent to unused one even if the use of a long time period wears the surface of the coating layer, it is possible to maintain the capability to provide a stable charge characteristic and a stable function to prevent toner from being adhered onto the carrier.

Still further, since the carrier contains an electroconductive fine powder, it is possible to adjust the electrical properties of the carrier to more desirable properties.

The second object of the present invention can be achieved by a method for making a carrier for developer of an electrostatic latent image, comprising the steps of preparing a coating solution for forming a resin coating layer, in which the coating solution contains resin particles in a state dispersed, by placing a matrix resin, the resin particles and an electroconductive fine powder in a solvent in which at least the matrix resin can be dissolved, but the particles of the resin cannot be dissolved (this requirement may be met at the time when the solution is prepared), and then applying the solution onto the core, and removing the solvent.

According to this method, it is possible to easily prepare a carrier having a coating layer in which the resin particles are uniformly dispersed.

The third object can be achieved by a developer of an electrostatic latent image, wherein the developer comprises the above-mentioned carrier and a toner.

The fourth object can be achieved by an image forming method for developing an electrostatic latent image on an electrostatic latent image carrying member by use of a developer layer containing toner and a carrier on a developer carrying member, wherein the carrier comprises a core covered with a resin coating layer containing resin particles and an electroconductive fine powder in the form of a dispersion in a matrix resin.

The fifth object can be achieved by an image forming apparatus to develop an electrostatic latent image on an electrostatic latent image carrying member by use of a developer layer containing toner and a carrier on a developer carrying member, wherein the carrier comprises a core covered with a resin coating layer containing resin particles and an electroconductive fine powder in the form of a dispersion in a matrix resin.

A high-quality image can be obtained for a long period of time by use of the above-described developer of an electrostatic latent image, method for forming image and apparatus for forming image.

DESCRIPTION OF THE PREFERRED EMBODIMENTS

The present invention is explained in detail below by way of embodiments.

Figure 1:
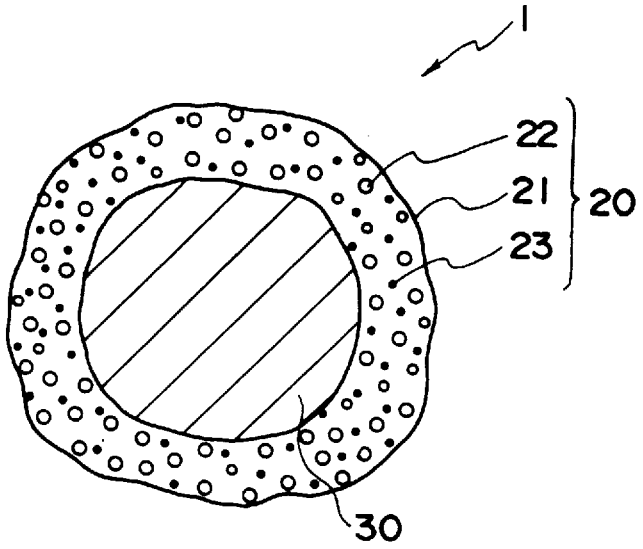
FIG. 1 is a schematic diagram illustrating an embodiment of a carrier for developer of an electrostatic latent image according to the present invention.

FIG. 1 illustrates an embodiment of a carrier for developer of an electrostatic latent image according to the present invention. The carrier 1 has a core 30 and a resin coating layer 20 thereon containing resin particles 22 and an electroconductive fine powder 23 dispersed in a matrix resin 21.

The matrix resin and the particulate resin may be of the same kind if these resins can be classified into each type in accordance with their manufacturing processes, molecular weights and the like. However, it is preferred that the resins each belongs to a different type, from the viewpoint of obtaining a plurality of well-balanced functions by use of materials different in performance.

Preferably, the resin particles are dispersed in the matrix resin as uniformly as possible in the direction of the thickness of the coating layer and also in the direction of a line tangent to the surface of the carrier. At the same time, preferably the matrix resin of the coating layer is also uniform. Owing to this construction, the entire carrier is enabled to exert a function to provide a charge characteristic and a function to prevent toner from being adhered onto the carrier in a stable manner. Further, the construction makes it possible to maintain these functions for a long period of time, because the surface composition of the coating layer equivalent to unused one can be always maintained even if the coating layer is worn from the surface thereof during use for a long time period.

It is preferable that the matrix resin and the resin of dispersed particles are mutually soluble at a high level (i.e., no phase segregation takes place at the time when the matrix resin and the resin for the particles are blended) in view of enhancing the uniformity of dispersion. Particularly, the mutual solubility of these resins is preferred, because the resin particles can be uniformly dispersed to a primary particle size.

Any of a thermoplastic resin and a thermosetting resin can be used for the resin particles to be dispersed in the resin coating layer. Any method may be used for the formation of the particles, if suitable particle sizes which will be described hereinbelow are obtainable. Preferably, the resin particles are in a state of fine particles prior to being blended with and dispersed in a carrier resin. Such a condition will make it easier to ensure the uniformity of the blending and dispersion or to confirm the uniformity of dispersion.

Resin particles may be selected from a variety of resins depending on the desired functions of the resin particles.

Examples of thermoplastic resins are polyolefinic resins, such as polyethylene and polypropylene; polyvinyl resins and polyvinylidene resins, such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinyl ketone; vinylchloride/vinylacetate copolymers, styrene/acrylic acid copolymers, straight silicone resins consisting of organosiloxane linkages or modified products thereof, fluorine-containing resins, such as polytetrafluoroethylene, polyvinyl fluoride, polyvinylidene fluoride and polychlorotrifluoroethylene; polyester and polycarbonate.

Examples of thermosetting resins are phenol resins, amino resins, such as urea/formaldehyde resins, melamine resins, benzoguanamine resins, urea resins or polyamide resins, and epoxy resins.

In order to enhance the mechanical strength of a carrier by means of resin particles, it is preferred to use particles of a thermosetting resin which can relatively easily increase the hardness. Particularly preferred is the use of particles of a crosslinked resin, which can be prepared by one of the following methods.

The methods include methods in which a granular resin is produced by the utilization of a polymerization process such as suspension polymerization or emulsion polymerization; a monomer or an oligomer is dispersed in a poor solvent and particles are formed by the action of surface tension while crosslinking reaction is conducted; and a component having a low molecular weight and a cross-linking agent are molten and mixed with each other to cause a reaction between them and then the reaction product is finely divided to a predetermined particle size by means of a wind force or a mechanical force.

The average particle diameter of the resin particles is preferably 0.1 to 2 $\mu$m, more preferably 0.2 to 1 $\mu$m. If the average particle diameter is less than 0.1 $\mu$m, the level of dispersion in a coating layer becomes extremely poor, whereas, if the average particle diameter is greater than 2 $\mu$m, the particles tend to be separated from the coating layer, which makes it impossible to maintain the inherent function of the particles.

When the average thickness of the resin coating layer is taken as 1, the average particle diameter of the resin particles is normally less than 1, preferably less than 0.8, and most preferably less than 0.5, so that the resin particles can be uniformly dispersed.

In the present invention, the number-based particle diameter distribution of the cross-linked particles is preferably controlled within a certain range. More specifically, the proportion of particles having particle diameters of not greater than $\frac{1}{2}\times d_{50}$ is not greater than 20 percent by number and the proportion of particles having particle diameters of not less than $2\times d_{50}$ is not greater than 20 percent by number. Here, $d_{50}$ means a number average particle diameter.

If the proportion of particles having particle diameters of not greater than $\frac{1}{2}\times d_{50}$ is greater than 20 percent by number, a large number of aggregation of smaller particles appear so that the uniformity of the composition of the coating layer is deteriorated. Further, characteristic of imparting charge to toner by contact becomes unstable. On the other hand, if the proportion of particles having particle diameters of not less than $2\times d_{50}$ is greater than 20 percent by number, the stability is impaired because the particles tend to be separated from the coating layer, since characteristic of imparting charge to toner varies as developer is used.

In the present invention, the particle diameter distribution is based on the values measured in the following way. The particles are observed by a scanning electron microscope and a photograph is taken at a magnification of 5,000. Then, after binary processing of hydrophobic inorganic particles and colored particles in the photograph by means of an image analyzer, a number-based particle diameter distribution is obtained from about 100 of randomly chosen hydrophobic inorganic particles based on a diameter corresponding to a circle. In this case, the hydrophobic inorganic particle is counted as one unit so long as the particle is capable of behaving as a unit particle, irrespective of the state of the particle, namely a primary particle or a secondary particle. Further, in the present invention, "number average particle diameter" means a particle diameter at a percentage which corresponds to a cumulative number of particles of 50 percent of the total number in a particle diameter distribution. And, it is generally called number-based mean diameter.

The total amount of the resin particles in the resin coating layer is normally 1 to 50 percent by volume, preferably 5 to 30 percent by volume, and most preferably 5 to 20 percent by volume.

The resin particles preferably contain a nitrogen atom therein having an electron-donating characteristic in order to impart negative charge to toner.

A matrix resin, which constitutes a coating layer containing the above-mentioned resin particles, may be any one selected from the resins currently utilized for forming a coating layer on a carrier in the art. Such resins may be used alone or may be used in a combination of two or more of them.

Examples of these resins are polyolefinic resins, such as polyethylene or polypropylene, polyvinyl resins and polyvinylidene resins, such as polystyrene, acrylic resins, polyacrylonitrile, polyvinyl acetate, polyvinyl alcohol, polyvinyl butyral, polyvinyl chloride, polyvinyl carbazole, polyvinyl ether or polyvinyl ketone, vinylchloride/vinylacetate copolymers, styrene/acrylic acid copolymers, straight silicone resins containing organosiloxane linkages or modified products thereof, fluorine-containing resins, such as polytetrafluoroethylene, polyvinyl fluoride, polyvinylidene fluoride and polychlorotrifluoroethylene, polyester, polycarbonate, phenol resins, amino resins, such as urea/formaldehyde resins, melamine resins, benzoguanamine resins, urea resins and polyamide resins, and epoxy resins.

In a carrier for a developer of an electrostatic latent image, a matrix resin has a critical surface tension ($\gamma c$) preferably of not greater than 35 dyn/cm and more preferably of not greater than 30 dyn/cm. By using such matrix resin, the surface energy is reduced to such a level that prevents toner from being adhered onto the surface of the carrier.

Examples of the resin having a critical surface tension of not greater than 35 dyn/cm are as follows.

Polystyrene ($\gamma c$=33 dyn/cm), polyethylene ($\gamma c$=31 dyn/cm), polyvinyl fluoride ($\gamma c$=28 dyn/cm), polyvinylidene fluoride ($\gamma c$=25 dyn/cm), polytrifluoroethylene ($\gamma c$=22 dyn/cm), polytetrafluoroethylene ($\gamma c$=18 dyn/cm), polyhexafluoropropylene ($\gamma c$=16 dyn/cm) . Other usable resins, which have a critical surface tension ($\gamma c$) of not greater than 35 dyn/cm, are, for example, a copolymer of vinylidene fluoride with an acrylic monomer, a copolymer of vinylidene fluoride with vinyl fluoride and a terpolymer such as a terpolymer of tetrafluoroethylene/vinylidene fluoride/fluorine-free monomer.

Particularly suitable as the matrix resin is a resin or polymer having a critical surface tension of 30 dyn/cm or less and the resin is exemplified by a fluorine-containing resin or polymer and/ or those containing a silicone resin.

An electroconductive fine powder, which is present in the resin coating layer, is utilized for the purpose of adjusting the electroconductivity. Because of the presence of the resin coating layer, a carrier is insulated and does not efficiently serve as an electrode for development so that an adverse effect such as inferior reproduction of a solid image, namely emergence of an edge effect in a black solid region, in particular, arise. The electroconductive fine powder has an additional function to eliminate such an adverse effect.

The electroconductivity of an electroconductive fine powder per se is preferably not greater than $10^{10}$ $\Omega$cm, more preferably not greater than $10^9$ Ωcm. A suitable electroconductive fine powder may be selected, in accordance with the kind of a matrix resin, from a variety of electroconductive fine powders which have an electroconductivity in the above-described range. Examples of the electroconductive fine powder are a metal such as gold, silver or copper, carbon black, a semiconductive oxide such as titanium oxide or zinc oxide, and a coated powder such as titanium oxide, zinc oxide, barium sulfate, aluminum borate or potassium titanate, coated with a material such as tin oxide, carbon black or a metal. Carbon black is preferred from the standpoint of stability in production, low cost and high electroconductivity. The type of carbon black is not limited and known types can be used. Particularly preferred is a type of carbon black which has an oil absorption amount in the range of 50 to 300 when measured using dibutyl phthalate and which has an excellent stability in production. The average particle diameter is preferably not greater than 0.1 μm, and the primary particle diameter is preferably not greater than 50 nm from the standpoint of dispersion.

A typical method for forming the above-mentioned resin coating layer on the surface of a core comprises in the utilization of a solution for forming a resin coating layer (containing a matrix solution, resin particles and an electroconductive fine powder in a solvent). Preferred examples of the method are an immersion method whereby a core material powder is immersed in a solution for forming a coating layer, a spray method whereby a solution for forming a coating layer is sprayed on the surface of a core material, a fluidized bed method whereby a solution for forming a coating layer is sprayed on a core powder which is floated by means of fluidizing air and a kneader coater method whereby a core powder and a solution for forming a coating layer are blended in a kneader and then the solvent is removed. The kneader coater method is particularly preferable in the present invention.

A solvent to be used for the solution for forming a coating layer is not particularly limited so far as the solvent dissolves a matrix resin. Examples of the solvent are aromatic hydrocarbons such as toluene and xylene, ketones such as acetone or methyl ethyl ketone, and ethers such as tetrahydrofuran and dioxane.

Since resin particles are desirably in a state of particles which have already been formed in a solvent, the resin particles are preferably substantially insoluble in the solvent. Owing to this insolubility, the resin particles can be kept in a state of primary particles without being aggregated in a resin coating layer.

If the resin particles are uniformly dispersed in a solvent, the particles can be uniformly dispersed in the resin coating layer to be formed. Therefore, it is preferred to prepare a solution for forming a coating layer in which the resin particles are uniformly dispersed. By the use of such solution, a uniform dispersion is very easily attainable. For example, a uniform dispersion can be obtained only if the entire solution is stirred.

The average film thickness of the resin coating layer formed in the above-described manner is normally in the range of 0.1 to 10 μm, preferably in the range of 0.2 to 3 μm. The average film thickness of the resin coating layer can easily be calculated according to the following equation, where $\rho_D$ is the specific gravity of a core material for carrier, D is the average particle diameter of the core material for carrier, $\rho_c$ is the average specific gravity of coated resins including the resin particles and $W_c$ is the total weight of coated resins.

Film thickness (1)=[weight of coated resins (including resin particles) per one carrier/surface area per one carrier] ÷average specific gravity of coated resins=$[4/3\pi\cdot(D/2)^3\cdot\rho_D\cdot W_c] / [4\pi(D/2)^3]\div\rho_c=(1/6)\cdot(D\cdot\rho_D\cdot W_c/\rho_c)$ The core (core for carrier) which is used in a carrier for developer of an electrostatic latent image in the present invention is not particularly limited, and examples of the core are magnetic metals such as iron, steel, nickel and cobalt, magnetic oxides such as ferrite or magnetite, and glass beads. However, from the standpoint of the use of a magnetic brush, it is preferred that the carrier be magnetic. The average particle diameter of the core is generally in the range of 10 to 150 μm, preferably in the range of 30 to 100 μm.

The carrier for developer of an electrostatic latent image in the present invention is used together with any type of granular toner to form a developer of an electrostatic latent image.

A colorant and a binder resin which constitute toner, are not particularly limited. Typical examples of the colorant are carbon black, nigrosin, aniline blue, chalcoyl blue, chrome yellow, ultramarine blue, Dupont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3.

Examples of the binder resins are homopolymers or copolymers, which are made up of styrenes such as styrene and chlorostyrene, monoolefins such as ethylene, propylene, butylene and isoprene, vinyl esters such as vinyl acetate, vinyl propionate, vinyl benzoate and vinyl acetate, esters of α-methylene aliphatic monocarboxylic acids, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, or vinyl ketones such as vinyl methyl ketone, vinyl hexyl ketone and vinyl isopropenyl ketone. Typical examples of the binder resins are polystyrenes, styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene. Other examples include polyesters, polyurethanes, epoxy resins, silicone resins, polyamides, modified rosins, paraffin and wax. Among the foregoing binder resins, particularly advantageous are polyesters. For example, linear polyester resins comprising polycondensation products, in which bisphenol A and an aromatic polycarboxylic acid are contained as primary monomeric substances, can preferably be used.

A particularly preferred resin is the one which has a softening point of 90° to 150° C., a glass transition point of 50° to 70° C., a number average molecular weight of 2,000 to 6,000, a weight average molecular weight of 8,000 to 150,000, an acid value of 5 to 30 and a hydroxyl value of 5 to 40.

If desired, the above-mentioned toner particles may be admixed with a known additive such as a charge controlling agent or a fixation aid.

Figure 2:
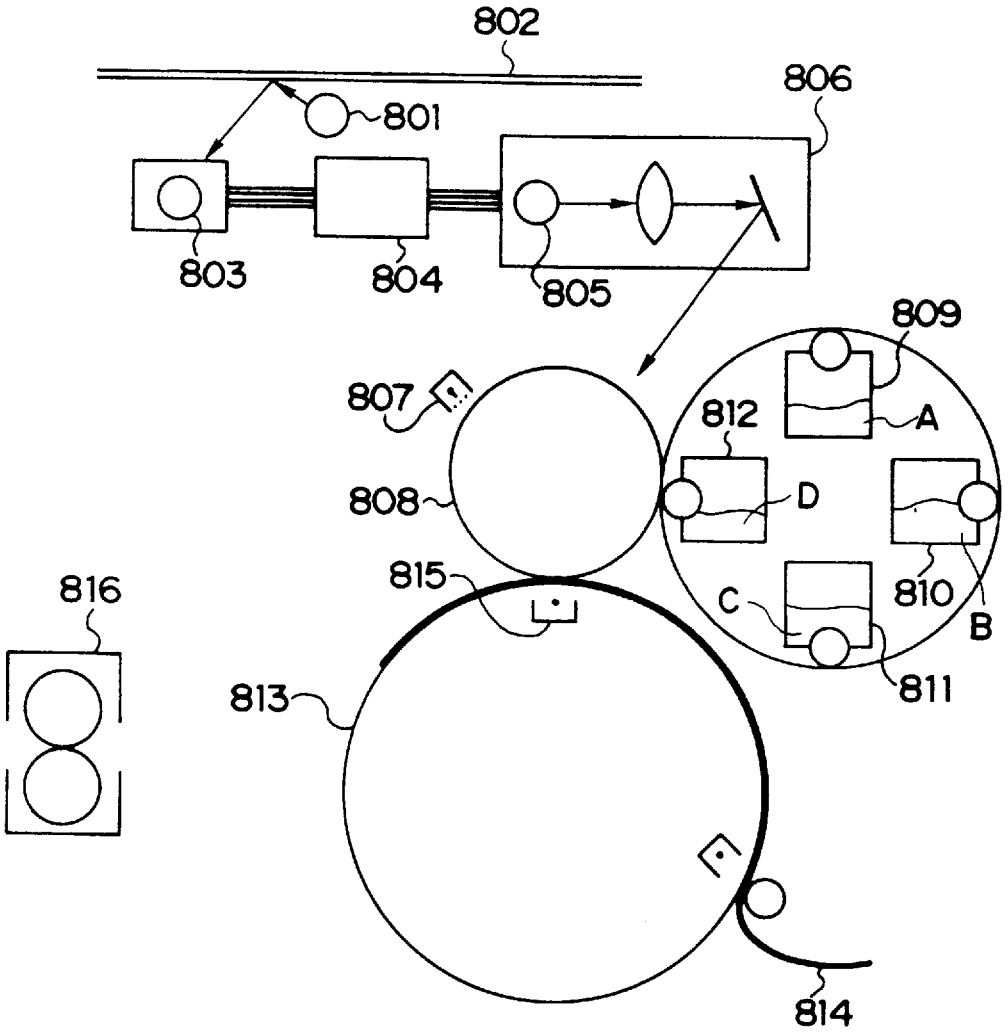
FIG. 2 is a schematic diagram illustrating an embodiment of an apparatus for forming an image according to the present invention.

By use of the above-described carrier and developer, an image can be formed utilizing, for example, an apparatus illustrated in FIG. 2. According to this apparatus, an original 802 is irradiated with the light from an illuminator 801. The reflected light is read by a color CCD 803 and is fed to an image processor unit 804, which separates the light into three colors of Y, M and C. Each color is image-processed and outputted from a semiconductor laser 805 in the form of light signals in succession, in which the angle between the closest pixels varies for each of the colors. The output light signals are passed through an optical system 806 to a photoreceptor 808 which has been electrically charged by means of a charger 807 to thereby form an electrostatic latent image in such a manner that an image region has a lower potential. Developing units 809–812 are filled with developers A, B, C and D which are electrostatically charged and comprise color toners and carriers obtained according to the procedures described hereinbefore. The development is conducted by attracting the color toners to the photoreceptor by means of an electrostatic force by applying development bias.

The toners after development are transferred to a paper 814, which is caused to adhere to a transfer drum 813 by means of an electrostatic force, one color after another, utilizing the electric field which is provided by a transfer corotron 815. This procedure is repeated three times in the order of Y, M and C to form, on the transfer paper, a colored toner image comprising a three-color superposition, followed by fixing thermally by the use of a fixing unit 816, to form a color image.

Preparation of Carriers

EXAMPLE 1

| Carrier A | parts by weight |
|---|---|
| Ferrite particles (Zn—Cu-Ferrite; average particle diameter: 50 μm) | 100 |
| Toluene | 14 |
| Styrene/methylmethacrylate copolymer (copolymerization ratio; 20:80, molecular weight; 50,000) (critical surface tension: 35 dyn/cm) | 1.5 |
| Carbon black (average particle diameter: 25 nm; DBP value 71; resistivity: not greater than $10^0$ Ωcm; "R330" from Cabot Company) | 0.15 |
| Particles of phenol resin (average particle diameter: 0.5 μm; insoluble in toluene) | 0.3 |

All of the above-identified ingredients except for the ferrite particles were dispersed by use of a stirrer for 10 minutes to prepare a solution for forming a coating layer.

The solution for forming the coating layer and the ferrite particles were placed in a kneader equipped with a vacuum deaerator. The contents were stirred for 30 minutes at 60° C. to distill off the toluene under a reduced pressure to thereby form a carrier having a resin coating layer. In this way, a carrier was obtained (it must be noted that the carbon black had been dispersed in the styrene/methylmethacrylate copolymer as a carrier resin with toluene by use of a sand mill). The average thickness of the resin coating layer was 0.7 μm.

EXAMPLE 2

| Carrier B | parts by weight |
|---|---|
| Ferrite particles (Zn—Cu-Ferrite; average particle diameter: 50 μm) | 100 |
| Toluene | 14 |
| Styrene/methylmethacrylate copolymer (polymerization ratio; 20:80, molecular weight; 50,000) (critical surface tension: 35 dyn/cm) | 1.0 |
| Perfluorooctylethylacrylate/methylmethacrylate copolymer (copolymerization ratio; 50:50, molecular weight; 50,000) (critical surface tension: 24 dyn/cm) | 0.8 |
| Electroconductive powder [$BaSO_4$] (average particle diameter: 0.2 μm; resistivity: 5 to 30 Ωcm; "Pastran" Type IV from Mitsui Mining & Smelting Co., Ltd.) | 0.4 |
| Particles of crosslinked nylon resin (average particle diameter: 0.3 μm; insoluble in toluene) | 0.2 |

All of the above-described ingredients except for the ferrite particles were dispersed by use of a homomixer for 10 minutes to prepare a solution for forming a coating layer. The solution and the ferrite particles were placed in a kneader equipped with a vacuum deaerator. The contents were stirred for 30 minutes at 60° C. to distill off the toluene under a reduced pressure to thereby form a carrier having a resin coating layer. In this way, a carrier was obtained (it must be noted that the electroconductive powder had been dispersed in the styrene/methyl methacrylate copolymer and the perfluorooctylethylacrylate/methymethacrylate copolymer as carrier resins with toluene by use of a sand mill). The average thickness of the resin coating layer was 0.6 μm.

EXAMPLE 3

| Carrier C | parts by weight |
|---|---|
| Ferrite particles (Zn—Cu-Ferrite; average particle diameter: 45 μm) | 100 |
| Toluene | 14 |
| Perfluorooctylethyl acrylate/methylmethacrylate copolymer (copolymerization ratio; 50:50, molecular weight; 50,000) (critical surface tension: 24 dyn/cm) | 1.7 |
| Electroconductive powder [$SnO_2$] (average particle diameter: 20 nm; resisitivity; $10^6$ to $10^8$ Ωcm; "S-1" from Mitsubishi Material Corp.) | 0.6 |
| Particles of crosslinked methyl methacrylate resin (average particle diameter: 0.3 μm; insoluble in toluene) | 0.3 |

All of the above-identified ingredients except for the ferrite particles were dispersed by use of a stirrer for 10 minutes to prepare a solution for forming a coating layer. The solution and the ferrite particles were placed in a kneader equipped with a vacuum deaerator. The contents were stirred for 30 minutes at 60° C. to distill off the toluene under a reduced pressure to thereby form carrier having a resin coating layer. In this way, a carrier was obtained (it must be noted that the tin oxide had been dispersed in the styrene/methylmethacrylate copolymer and the perfluorooctylethylacrylate/methylmethacrylate copolymer as carrier resins with toluene by the use of a sand mill). The average thickness of the resin coating layer was 0.6 μm.

EXAMPLE 4

| Carrier D | parts by weight |
|---|---|
| Ferrite particles (Zn—Cu-Ferrite; average particle diameter: 45 μm) | 100 |
| Toluene | 14 |
| Perfluorooctylethylacrylate/ methylmethacrylate copolymer (copolymerization ratio; 50:50, molecular weight; 50,000) (critical surface tension: 24 dyn/cm) | 1.6 |
| Carbon black (average particle diameter: 30 nm; DBP value 174; resistivity: not greater than $10^0$ Ωcm; "VXC-72" from Cabot Company) | 0.12 |
| Particles of crosslinked melamine resin (average particle diameter: 0.3 μm; insoluble in toluene) | 0.3 |

All of the above-identified ingredients except for the ferrite particles were dispersed by use of a stirrer for 10 minutes to prepare a solution for forming a coating layer. The solution and the ferrite particles were placed in a kneader equipped with a vacuum deaerator. The contents were stirred for 30 minutes at 60° C. to distill off the toluene under a reduced pressure to thereby form a carrier having a resin coating layer. In this way, a carrier was obtained (it must be noted that the carbon black had been dispersed in the perfluorooctylethylacrylate/methylmethacrylate copolymer as a carrier resin with toluene by the use of a sand mill). The average thickness of the resin coating layer was 0.6 μm.

COMPARATIVE EXAMPLE 1 (WITHOUT RESIN PARTICLES)

Carrier E

The procedure of Example 1 was repeated to obtain a carrier except that the particles of the phenol resin were not used. The average thickness of the resin coating layer was 0.6 μm.

Comparative Example 2 (without particles of electroconductive powder)

Carrier F

The procedure of Example 4 was repeated to obtain a carrier except that the carbon black was not used. The average thickness of the resin coating layer was 0.6 μm.

COMPARATIVE EXAMPLE 3 (WITHOUT RESIN PARTICLES AND ELECTROCONDUCTIVE POWDER)

| Carrier G | parts by weight |
|---|---|
| Ferrite particles (Zn—Cu-Ferrite; average particle diameter: 45 μm) | 100 |

-continued

| Carrier G | parts by weight |
|---|---|
| Toluene | 14 |
| Perfluorooctylethylacrylate/ methymethacrylate copolymer (polymerization ratio; 50:50, molecular weight; 50,000) critical surface tension: 24 dyn/cm) | 0.8 |
| Copolymer of methylmethacrylate and dimethylaminoethylmethacrylate (copolymerization ratio; 80:20, molecular weight; 50,000, critical surface tension: 42 dyn/cm) | 1.5 |

All of the above-identified ingredients except for the ferrite particles were dispersed in a stirrer for 10 minutes to prepare a solution for forming a coating layer. The solution and the ferrite particles were placed in a kneader equipped with a vacuum deaerator. The contents were stirred for 30 minutes at 60° C. to distill off the toluene under a reduced pressure to thereby form a carrier having a resin coating layer. In this way, a carrier was obtained. The average thickness of the resin coating layer was 0.8 μm.

Comparative Example 4 (corresponding to the technique disclosed by Japanese Patent Application Laid-Open (JP-A) No. 1-105,264 which utilizes two resins but none of dispersed resin particles in a resin coating layer)

| Carrier H | parts by weight |
|---|---|
| Ferrite particles (Zn—Cu-Ferrite; average particle diameter: 45 μm) | 100 |
| Toluene | 14 |
| Perfluorooctylethylacrylate/ methymethacrylate copolymer (polymerization ratio; 50:50, molecular weight; 50,000) (critical surface tension: 24 dyn/cm) | 1.6 |
| Carbon black ("VXC-72" from Cabot Company) | 0.12 |
| Particles of uncrosslinked melamine resin | 0.3 |

All of the above-identified ingredients except for the ferrite particles were dispersed in a stirrer for 10 minutes to prepare a solution for forming a coating layer. The solution and the ferrite particles were placed in a kneader equipped with a vacuum deaerator. The contents were stirred for 30 minutes at 60° C. to distill off the toluene under a reduced pressure. Then, the contents were further stirred for 60 minutes at 150° C. to thereby form a carrier having a resin coating layer containing a thermally crosslinked melamine resin so that a carrier was obtained (it must be noted that the carbon black had been dispersed in the perfluorooctylethylacrylate/methylmethacrylate copolymer as a carrier resin with toluene by the use of a sand mill). The average thickness of the resin coating layer was 0.7 μm. The coating layer had a two-layered construction where one layer was superposed on the other in a consecutive way.

Preparation of Developers

Eight developers were prepared by blending 100 parts by weight of each of the carriers, which had been prepared in Examples 1–4 and in Comparative Examples 1–4, with 6 parts by weight of toner. These developers were designated as Developers 1–8, respectively (Developers 5–8 were for comparison).

The toner used for the preparation of the developers was magenta toner (Toner A), which had a particle diameter of 8 μm and was prepared in the following way.

| Toner A | % by weight |
|---|---|
| Linear polyester resin (a linear polyester obtained from terephthalic acid/bisphenol A ethylene oxide adduct/cyclohexane dimethanol; Tg = 62° C.; Mn = 4,000; Mw = 35,000; Acid Value = 12; Hydroxyl Value = 25) | 100 |
| Magenta pigment (C.I. Pigment Red 57) | 3 |

The above-identified ingredients were blended in an extruder, and thereafter, was pulverized by means of a jet mill. The resultant powder was treated by a classifier utilizing a wind force to obtain particles of magenta toner of $d_{50}$=8 μm. The magenta toner particles were blended with 0.4 percent by weight of silica ("R972" from Nippon Aerosil Co., Ltd.) by means of a Henschel mixer to obtain magenta toner (Toner A).

Formation of Images and Evaluation of the Images

Utilizing these developers, 10,000 copies were made by means of a copying machine of electrostatic photography ("A-Color 630" from Fuji Xerox Co., Ltd.) in an environment of moderate temperature and humidity (22° C., 55% RH). The results are shown in Table 1.

| Resin-coated carrier | Toner | Developer No. | Initial image (in an environment of intermediate temperature and humidity) | Initial stage: Amount of electrostatic charge (μC/g) | Initial stage: Fog on background | After taking 3,000 copies: Amount of electrostatic charge (μC/g) | After taking 3,000 copies: Fog on background | After taking 10,000 copies: Amount of electrostatic charge (μC/g) | After taking 10,000 copies: Fog on background |
|---|---|---|---|---|---|---|---|---|---|
| A | A | 1 | Excellent without edge effect | −22.1 | I | −20.1 | I | −21.1 | I |
| B | A | 2 | Excellent without edge effect | −23.5 | I | −22.5 | I | −20.8 | I |
| C | A | 3 | Excellent without edge effect | −20.2 | I | −19.4 | I | −18.2 | I |
| D | A | 4 | Excellent without edge effect | −24.5 | I | −23.2 | I | −23.0 | I |
| E | A | 5 | Excellent without edge effect | −18.0 | I | −16.0 | II | −13.0 | III |
| F | A | 6 | Edge effect observed | −25.9 | I | −20.6 | I | −14.1 | II |
| G | A | 7 | Edge effect observed | −26.8 | I | −26.8 | I | −15.8 | II |
| H | A | 8 | Excellent without edge effect | −23.8 | I | −26.8 | I | −15.8 | II |

In Table 1, the amounts of charge indicate a values obtained by image analysis according to CSG (Charge Spectrography).

Fog was evaluated by visual inspection. Roman numeral I indicates that no fog was observed; II indicate that a slight fog was observed; III indicates that a high fog was observed.

Developers 1–4, which utilized the carriers of Examples, generally provided stabilized images, which were free of such defects as fluctuation in the image density and fog on background. Measurements were conducted of the amounts of charge at the initial stage, at the stage after making 3,000 copies and at the stage after making 10,000 copies.

On the other hand, Developers 5–8, which utilized the carriers of Comparative Examples 1–4, respectively, caused gradual reduction in the amount of electrostatic charge to an extent that fog on background was observed. Stains due to these toners were observed on the interior of the copying machine.

In addition, Developers 6 and 7, which utilized the carriers of Comparative Examples 2 and 3, respectively, brought about a conspicuous edge effect.

Evaluation of the Performance by Use of Another Toner

Preparation of Developers

Four developers were prepared by blending 100 parts by weight of each of the carriers, which had been prepared in Examples 1–4, with 6 parts by weight of toner. These developers were designated as Developers 9–12, respectively.

The toner used for the preparation of the developers was a black toner (Toner B), which had a particle diameter of 9 μm and was prepared in the following way.

| Toner B | % by weight |
|---|---|
| Linear polyester resin (a linear polyester obtained from terephthalic acid/bisphenol A ethylene oxide adduct/cyclohexane dimethanol; Tg = 62° C.; Mn = 4,000; Mw = 35,000; Acid Value = 12; Hydroxyl Value = 25) | 100 |
| Carbon black ("Morgal L" from Cabot Company) | 6 |

The above-identified ingredients were blended in an extruder, and thereafter, was pulverized by means of a mill for a bulky powder. The resultant powder was treated by a classifier utilizing a wind force to obtain particles of black toner of $d_{50}$=9 μm. The particles of the black toner were blended with 0.4 percent by weight of silica ("R972" from Nippon Aerosil Co., Ltd.) by means of a Henschel mixer to obtain black toner (Toner B).

Formation of Images and Evaluation of the Images

Utilizing these developers, 10,000 copies were made by means of a copying machine of electrostatic photography ("A-Color 630" from Fuji Xerox Co., Ltd.) in an environment of moderate temperature and humidity (22° C., 55% RH). The results are shown in Table 2.

| Resin-coated carrier | Toner | Developer No. | Initial image (in an environment of intermediate temperature and humidity) | Initial stage: Amount of electrostatic charge (μC/g) | Initial stage: Fog on background | After taking 3,000 copies: Amount of electrostatic charge (μC/g) | After taking 3,000 copies: Fog on background | After taking 10,000 copies: Amount of electrostatic charge (μC/g) | After taking 10,000 copies: Fog on background |
|---|---|---|---|---|---|---|---|---|---|
| A | B | 9 | Excellent without edge effect | −22.1 | I | −23.1 | I | −21.1 | I |
| B | B | 10 | Excellent without edge effect | −23.5 | I | −23.0 | I | −20.5 | I |
| C | B | 11 | Excellent without edge effect | −21.2 | I | −19.9 | I | −18.2 | I |
| D | B | 12 | Excellent without edge effect | −23.0 | I | −23.2 | I | −21.8 | I |

Developers 9–12 according to the present invention, generally provided stabilized images, which were free of such defects as fluctuation in the image density and fog on background. Measurements were conducted of the amounts of charge at the initial stage, at the stage after taking 3,000 copies and at the stage after taking 10,000 copies. The obtained images were free of edge effect and were sharp.

As stated in the above, the present invention provides a carrier for developer of an electrostatic latent image, the carrier being excellent in the ability to impart a suitable and stable charge characteristic to toner. The carrier has a structure durable enough to maintain the ability for a long period of time such that the structure can prevent toner from adhering onto the carrier surface for a long period of time. Accordingly, a system, which comprises a developer utilizing the above-mentioned carrier, an image forming method utilizing the developer and an image forming apparatus utilizing the developer, can maintain the capability to produce an electrostatic photographic image featured by such advantage as excellence in reproduction of halftone for a long period of time.

In addition, the above-described method of making the carrier for a developer of electrostatic latent image according to the present invention can provide an easy preparation of preferable types of carriers.

What is claimed is:

1. A carrier for developer of an electrostatic latent image, said carrier comprising a core covered with a resin coating layer containing resin particles and an electroconductive fine powder in a form of a dispersion in a matrix resin, wherein the resin particles have a particle size distribution such that a proportion of particles having particle diameters of not greater than $\frac{1}{2}\times d_{50}$ is not greater than 20 percent by number, and a proportion of particles having particle diameters of not less than $2\times d_{50}$ is not greater than 20 percent by number, where $d_{50}$ is defined as a number average particle diameter.

2. A carrier for developer of an electrostatic latent image according to claim 1, wherein the resin particles have an average particle diameter in the range of 0.1 to 2 μm.

3. A carrier for developer of an electrostatic latent image according to claim 1, wherein the average thickness of the resin coating layer is in the range of 0.1 to 10 μm.

4. A carrier for developer of an electrostatic latent image according to claim 3, wherein the average particle diameter of the resin particles is not greater than 1 where the average thickness of the resin coating layer is taken as 1.

5. A carrier for developer of an electrostatic latent image according to claim 1, wherein the resin particles are made up of a nitrogen-containing resin.

6. A carrier for developer of an electrostatic latent image according to claim 1, wherein the resin particles has an electric resistivity of not greater than $10^{10}$ Ωcm.

7. A carrier for developer of an electrostatic latent image according to claim 1, wherein the matrix resin has a critical surface tension of not greater than 35 dyn/cm.

8. A carrier for developer of an electrostatic latent image according to claim 1, wherein the average diameter of the core is in the range of 10 to 150 μm.

9. A carrier for developer of an electrostatic latent image according to claim 5, wherein the resin particles are made up of at least one thermoplastic resin selected from the group consisting of polyolefinic resins, polyvinyl resins, polyvinylidene resins, vinylchloride/vinylacetate copolymers, styrene/acrylic acid copolymers, straight silicone resins consisting of organosiloxane linkages or modified products thereof, fluorine-containing resins, polyester resins and polycarbonate resins, or are made up of at least one thermosetting resin selected from the group consisting of phenol resins and amino resins.

10. A carrier for developer of an electrostatic latent image according to claim 7, wherein the matrix resin is made up of at least one resin selected from the group consisting of polyolefinic resins, polyvinyl resins, polyvinylidene resins, vinylchloride/vinylacetate copolymers, styrene/acrylic acid copolymers, straight silicone resins, consisting of organosiloxane linkages or modified products thereof, fluorine-containing resins, polyesters, polyurethane resins, polycarbonate resins, phenol resins, amino resins and epoxy resins.

11. A method for making a carrier for developer of an electrostatic latent image, comprising the steps of:

preparing a coating solution for forming a resin coating layer, wherein the coating solution contains resin particles in a state dispersed in a solvent wherein the resin particles have a particle size distribution such that a proportion of particles having particle diameters of not greater than $\frac{1}{2}\times d_{50}$ is not greater than 20 percent by number, and a proportion of particles having particle diameters of not less than $2\times d_{50}$ is not greater than 20 percent by number, where $d_{50}$ is defined as a number average particle diameter, by placing a matrix resin, the resin particles and an electroconductive fine powder in a solvent which can dissolve at least the matrix resin, but cannot dissolve the resin particles, applying the solution to the core, and removing the solvent.

12. A method for making a carrier for developer of an electrostatic latent image according to claim 11, wherein the coating solution for forming a resin coating layer containing the electroconductive fine powder is also dispersed in the solvent.

13. A developer of an electrostatic latent image, said developer comprising a carrier for developer of an electrostatic latent image, wherein the carrier has, on a core, a resin coating layer containing resin particles and an electroconductive fine powder dispersed in a matrix resin, wherein the resin particles have a particle size distribution such that a proportion of particles having particle diameters of not greater than $\frac{1}{2}\times d_{50}$ is not greater than 20 percent by number, and a proportion of particles having particle diameters of not less than $2\times d_{50}$ is not greater than 20 percent by number, where $d_{50}$ is defined as a number average particle diameter, and a toner.

14. A developer of an electrostatic latent image according to claim 13, wherein a linear polyester is incorporated as a binder resin for the toner.

15. An image forming method for developing an electrostatic latent image on an electrostatic latent image carrying member by use of a layer of a developer containing toner and a carrier on a developer carrying member, wherein the carrier comprises a core covered with a resin coating layer containing resin fine particles and an electroconductive fine powder in a form of a dispersion in a matrix resin wherein the resin particles have a particle size distribution as such that a proportion of particles having particle diameters of not greater than $\frac{1}{2}d_{50}$ is not greater than 20 percent by number, and a proportion of particles having particle diameters of not less than $2\times d_{50}$ is not greater than 20 percent by number, where $d_{50}$ is defined as a number average particle diameter.

16. An image forming method according to claim 15, wherein the resin particles are made up of a crosslinked resin.

17. An image forming apparatus to develop an electrostatic latent image on an electrostatic latent image carrying member by use of a layer of a developer containing toner and a carrier on a developer carrying member, wherein the carrier comprises a core covered with a resin coating layer containing resin particles and an electroconductive fine powder in a form of a dispersion in a matrix resin, wherein the resin particles have a particle size distribution such that a proportion of particles having particle diameters of not greater than $\frac{1}{2}\times d_{50}$ its not greater than 20 percent by number, and a proportion of particles having particle diameters of not less than $2\times d_{50}$ is not greater than 20 percent by number, where $d_{50}$ is defined as a number average particle diameter.

18. An image forming apparatus according to claim 17, wherein the resin particles are made up of a crosslinked resin.

19. A carrier for developer of an electrostatic latent image, said carrier comprising a core covered with a resin coating layer containing (a) resin particles comprised of a crosslinked resin and (b) an electroconductive fine powder in the form of a dispersion in a matrix resin.

20. A carrier for developer of an electrostatic latent image according to claim 19, wherein the carrier is made by preparing a coating solution for forming a resin coating layer, wherein the coating solution contains resin particles in a state dispersed in a solvent, by placing the matrix resin, the resin particles and the electroconductive fine powder in a solvent which dissolves at least the matrix resin but does not dissolve the resin particles, applying the coating solution to the core, and removing the solvent.

* * * * *